US009551184B2

(12) United States Patent
Webster et al.

(10) Patent No.: US 9,551,184 B2
(45) Date of Patent: Jan. 24, 2017

(54) ROOF CLIMBING TOOL

(71) Applicants: Daniel Webster, Roscoe, IL (US); Gary Graves, Beloit, WI (US)

(72) Inventors: Daniel Webster, Roscoe, IL (US); Gary Graves, Beloit, WI (US)

(73) Assignee: Daniel Webster, Roscoe, IL (US)

( * ) Notice: Subject to any disclaimer, the term of this patent is extended or adjusted under 35 U.S.C. 154(b) by 1 day.

(21) Appl. No.: 14/483,692

(22) Filed: Sep. 11, 2014

(65) Prior Publication Data

US 2015/0068839 A1 Mar. 12, 2015

Related U.S. Application Data

(60) Provisional application No. 61/876,985, filed on Sep. 12, 2013.

(51) Int. Cl.

| | |
|---|---|
| ***E06C 7/48*** | (2006.01) |
| ***E06C 1/34*** | (2006.01) |
| ***E06C 1/10*** | (2006.01) |
| ***E06C 1/36*** | (2006.01) |
| ***E06C 1/38*** | (2006.01) |
| ***E06C 7/18*** | (2006.01) |

(52) U.S. Cl.

CPC ..... *E06C 7/488* (2013.01); *E06C 1/10* (2013.01); *E06C 1/345* (2013.01); *E06C 1/36* (2013.01); *E06C 1/381* (2013.01); *E06C 7/183* (2013.01)

(58) Field of Classification Search

CPC ..... E06C 7/488; E06C 1/381

See application file for complete search history.

(56) References Cited

U.S. PATENT DOCUMENTS

| | | | | | |
|---|---|---|---|---|---|
| 2,052,439 | A * | 8/1936 | Bailey | E06C 1/12 | 182/189 |
| 2,556,998 | A * | 6/1951 | Frazier | E06C 1/345 | 182/206 |
| 2,629,532 | A * | 2/1953 | Tupper | E06C 1/345 | 182/163 |
| 3,019,851 | A * | 2/1962 | Doss | E06C 1/381 | 182/111 |
| D256,260 | S * | 8/1980 | Lay, Jr. | D21/422 | |
| 4,279,327 | A * | 7/1981 | Warren | E06C 1/345 | 182/152 |
| 4,592,446 | A * | 6/1986 | White | E06C 1/125 | 182/100 |
| 4,844,207 | A * | 7/1989 | Andrews | E06C 1/381 | 182/100 |
| 5,109,954 | A * | 5/1992 | Skyba | E06C 1/10 | 182/100 |
| 6,003,629 | A * | 12/1999 | Cloutier | E04G 3/26 | 182/113 |
| 6,092,624 | A * | 7/2000 | Slater | E04D 15/00 | 182/206 |

(Continued)

*Primary Examiner* — Alvin Chin-Shue

(74) *Attorney, Agent, or Firm* — Leydig, Voit & Mayer, Ltd.

(57) ABSTRACT

A tool for engaging a roof includes a peak engagement member for engaging a first surface of the roof, and an operator climbing member including an elongated central body and a plurality of spaced apart step handles mounted on the central body. The operator climbing member is configured for engaging the second surface of the roof and is operatively connected to the peak engagement member.

12 Claims, 8 Drawing Sheets

(56) References Cited

U.S. PATENT DOCUMENTS

| | | | | |
|---|---|---|---|---|
| 8,439,162 | B1 * | 5/2013 | Galloway | E06C 1/381 182/100 |
| 2011/0315478 | A1 * | 12/2011 | Foster, Sr. | E06C 1/10 182/129 |
| 2014/0020979 | A1 * | 1/2014 | Squires | E06C 1/381 182/123 |
| 2015/0129356 | A1 * | 5/2015 | Strawder | A62B 35/0068 182/3 |
| 2015/0225969 | A1 * | 8/2015 | O'Grady, Sr. | E04G 3/265 182/45 |

* cited by examiner

ROOF CLIMBING TOOL

CROSS-REFERENCE TO RELATED APPLICATIONS

This patent application claims the benefit of U.S. Provisional Patent Application No. 61/876,985, filed Sep. 12, 2013, which is incorporated by reference.

BACKGROUND

This disclosure relates generally to tools for use on roofs and, more particularly, to a tool to assist in scaling an inclined roof.

Scaling and inspection of a roof with a steep ridge can be a dangerous task, even for a trained professional. Serious injuries or death may occur as a result of falling while working on or trying to gain access to a rooftop.

Conventional methods used to access steep roofs often involve difficult and time consuming processes. Professionals typically use a personal fall arrest system containing an anchor point, safety line, and harness. The safety line (typically a rope) connects the harness to the anchor point. The set up of the fall arrest system requires climbing up a ladder to get a safety line across one side of the building to another, climbing down the ladder to tie down one end of the safety line, and finally putting on harness gear and climbing back up a ladder. This process must be fully repeated for accessing, inspecting, or repairing the other side of the roof.

Another method for accessing and inspecting steep roofs involves the use of ladder with a roof hook affixed to the ladder. Using the ladder with the roof hook affixed often requires carrying this second ladder up a ladder. Carrying a second ladder while climbing a first ladder increases the difficulty and risks associated with accessing and performing tasks on the roof.

There is a need for an apparatus that can be used by individuals to scale, inspect, and work on steep roofs that is both time-efficient and reduces the risk of injury or death to an individual needing to scale or inspect steep roofs.

SUMMARY

In one aspect, a tool for engaging a roof includes a peak engagement member for engaging a first surface of the roof, and an operator climbing member including an elongated central body and a plurality of spaced apart step handles mounted on the central body. The operator climbing member is configured for engaging the second surface of the roof and is operatively connected to the peak engagement member.

In another aspect, a manually manipulatable tool for engaging a roof including a peak engagement section for engaging a first surface of the roof and an operator engagement section for engaging a second surface of the roof. The operator engagement section is operatively connected to the peak engagement member and includes an elongated body and a plurality of spaced apart step handles. The body includes a plurality of shaft sections and each step handle includes a handle and a foot engaging section.

In still another aspect, a tool for use on a roof includes a peak engagement section for engaging a roof adjacent a peak of the roof and an operator engagement section operatively connected to the peak engagement section. The operator engagement section includes an elongated central shaft and a plurality of spaced apart step handles. Each step handle has a handle generally parallel to the body and a foot engaging section.

DETAILED DESCRIPTION

Figure 1:
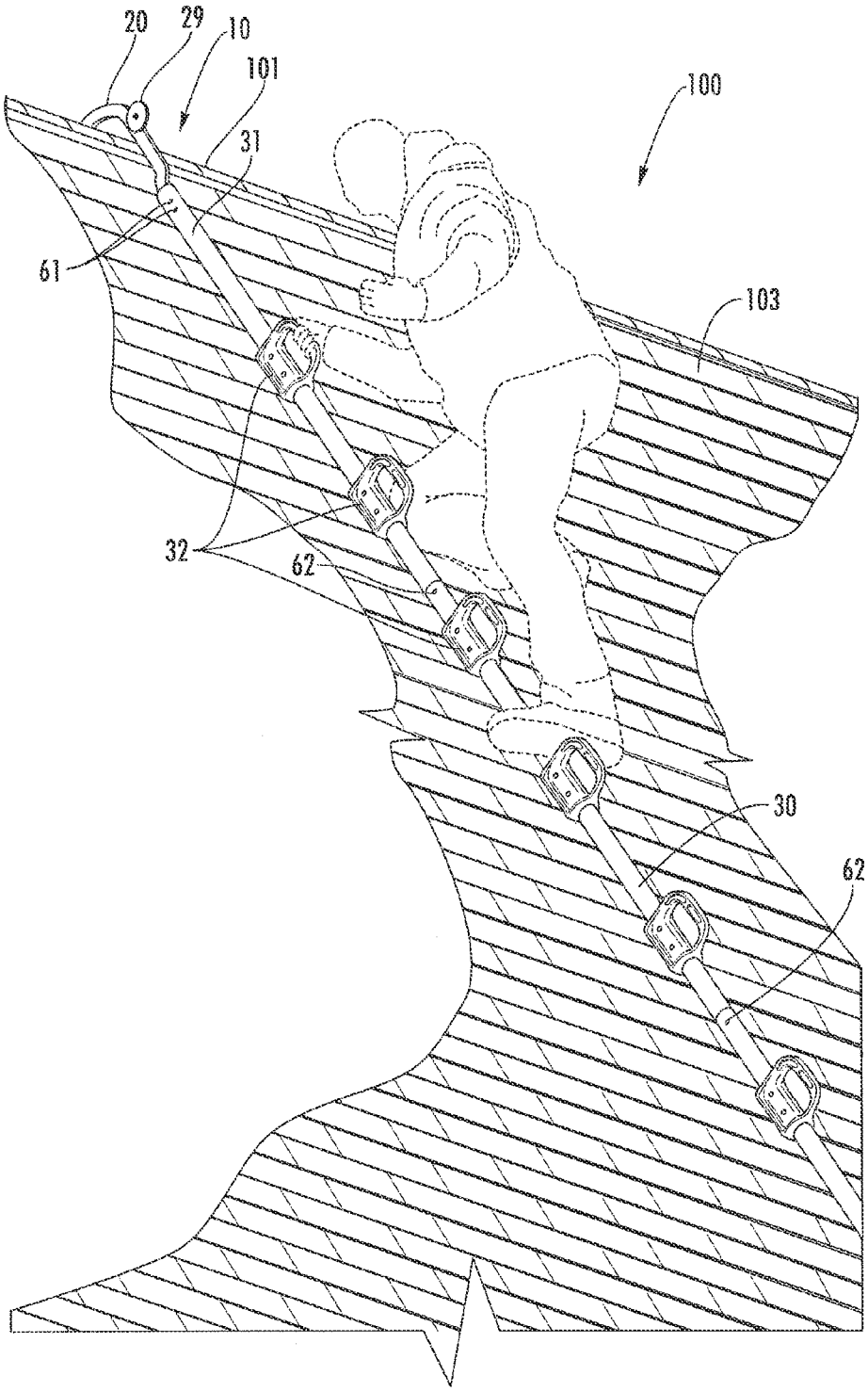
FIG. 1 depicts a perspective view of a portion of a roof climbing tool in use in accordance with the disclosure.

Referring to FIG. 1, a roof climbing tool 10 is positioned on roof 100. Roof 100 may include a first roof surface 102, a second roof surface 103, both of which are connected by peak 101. The climbing tool 10 aids individuals in accessing, climbing upon, and scaling roof 100 while inspecting or working on the roof. The roof climbing tool includes a peak engagement section 20 and an operator climbing or engagement section or member 30.

The peak engagement section 20 is configured to extend over or around a peak 101 of the roof 100 to engage and secure the roof climbing tool 10 to the roof. The peak engagement section 20 may include a body 21 having a curved or arcuate section or member 22. The arcuate member 22 may be generally U-shaped and is configured so that the peak 101 of roof 100 may be positioned within the open area 23 defined by the arcuate member 22.

Figure 8:
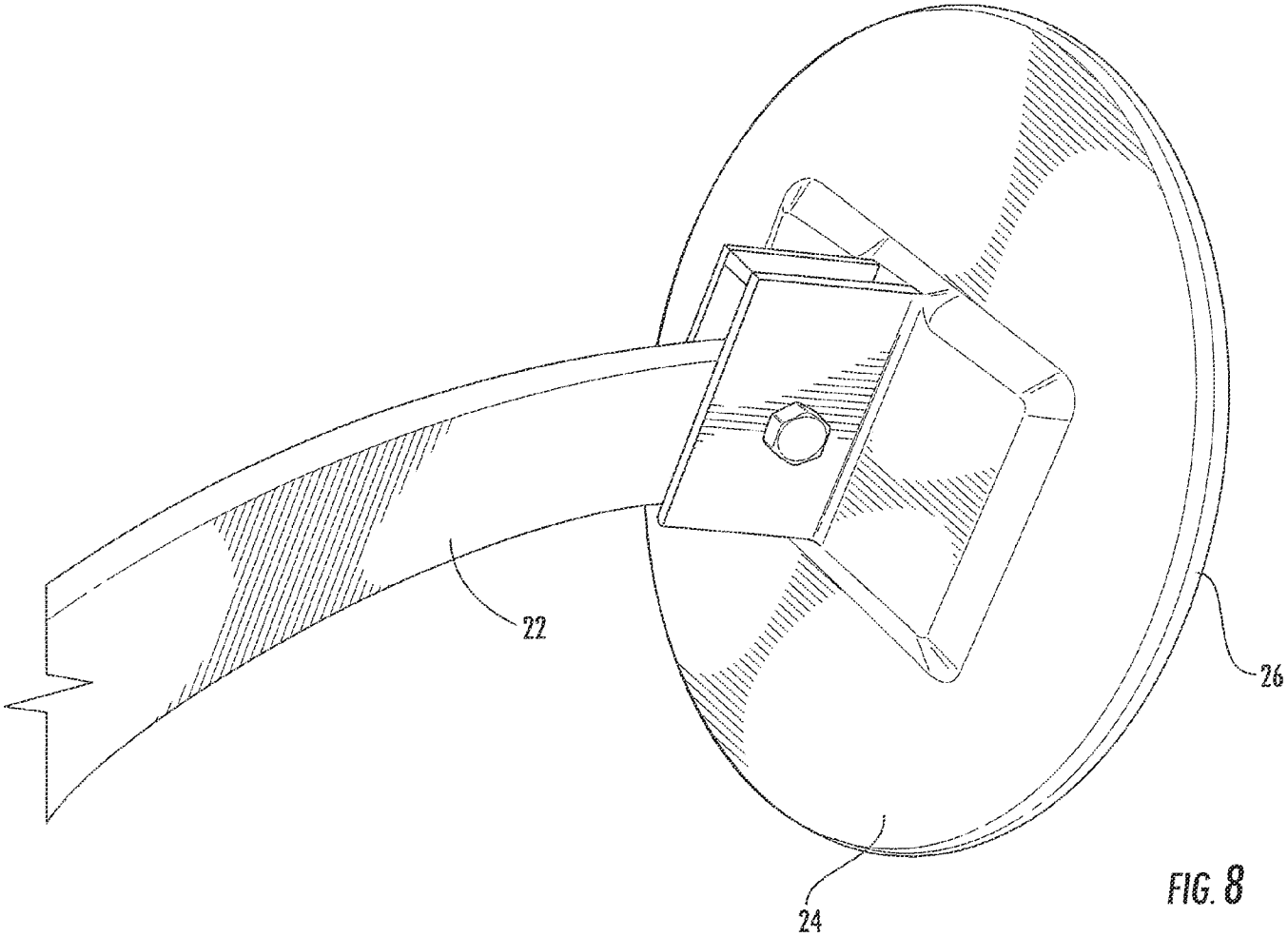
FIG. 8 depicts an alternate embodiment of a roof engaging member.

A roof engaging member 24 may be pivotably mounted on one end of the peak engagement section 20. The roof engaging member 24 may be mounted on the arcuate member 22 such as with bolts or other fasteners. The roof engaging member 24 may include a flat roof engaging surface 25 that, when combined with the pivoting movement of the roof engaging member 24, results in the flat surface 25 engaging the first roof surface 102 in a parallel or flat manner so as to evenly distribute forces from the roof climbing tool 10 onto the roof 100. This reduces the likelihood of damage to the roof 100 and increases the stability of the roof climbing tool 10 while in use by an operator. The roof engaging member 24 may be any desired shape such as L-shaped (FIG. 3) or rectangular (FIG. 9) and the flat surface 25 may be any desired shape such as rectangular (FIGS. 3, 9) or circular (FIG. 8). A grip pad 26 (FIG. 8) may be affixed to the roof engaging surface 25 to further reduce the likelihood of damage to the roof 100 and to further increase the stability of the roof climbing tool 10 while in use by an operator.

Figure 3:
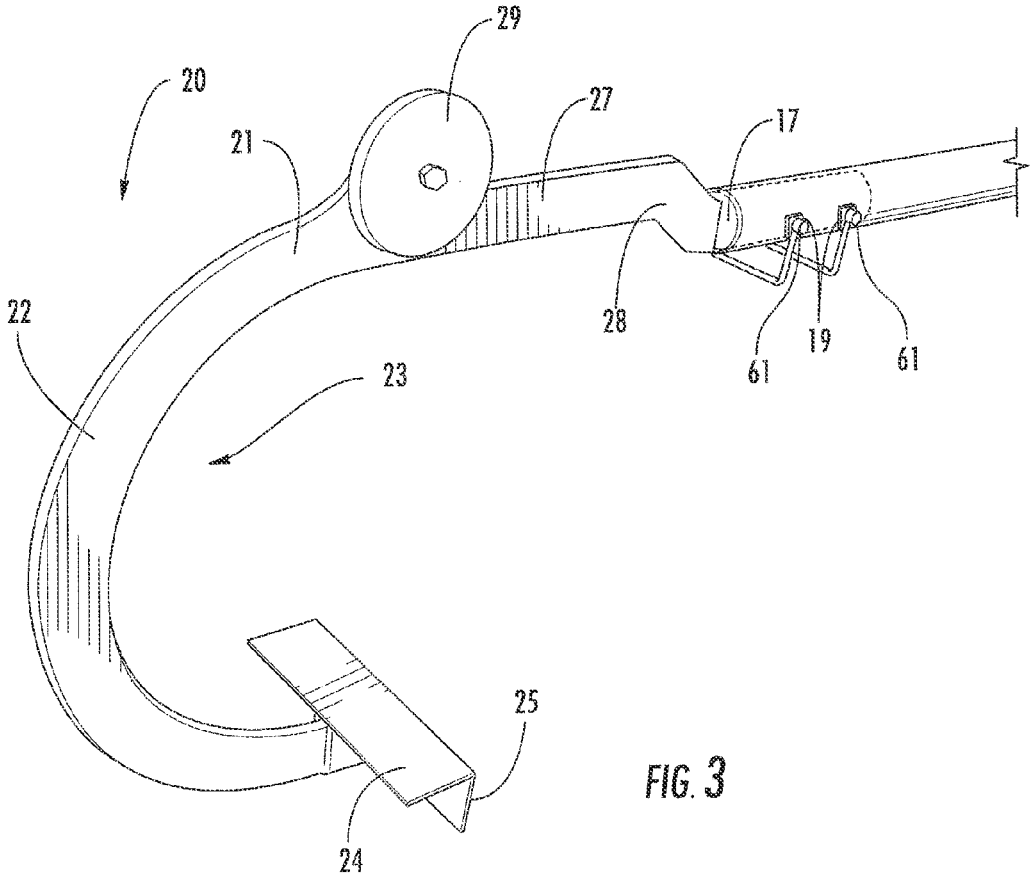
FIG. 3 depicts a perspective view of a peak engagement section of the roof climbing tool of FIG. 1.

Body 21 of peak engagement section 20 may include a generally straight member or section 27 that extends from an end of the arcuate member 22 opposite the roof engaging member 24. In other words, as depicted in FIG. 3, arcuate member 22 may include roof engaging member 24 at one end and intersect with section 27 at an opposite end across the open area 23. If desired, body 21 may also include an offset or dog-leg section 28 that is mounted to the operator engagement section 30 to shift the peak engagement section 20 relative to the operator engagement section.

Figure 2:
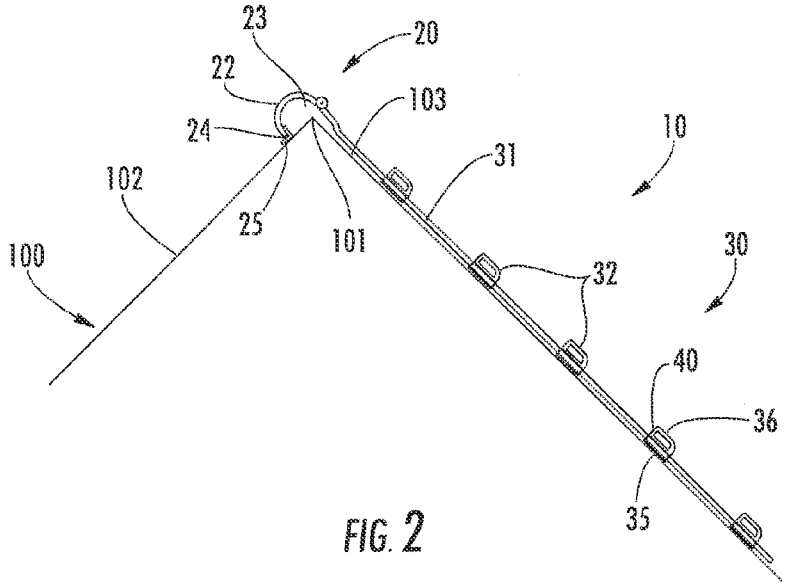
FIG. 2 depicts a side view of the roof climbing tool of FIG. 1.
Figure 4:
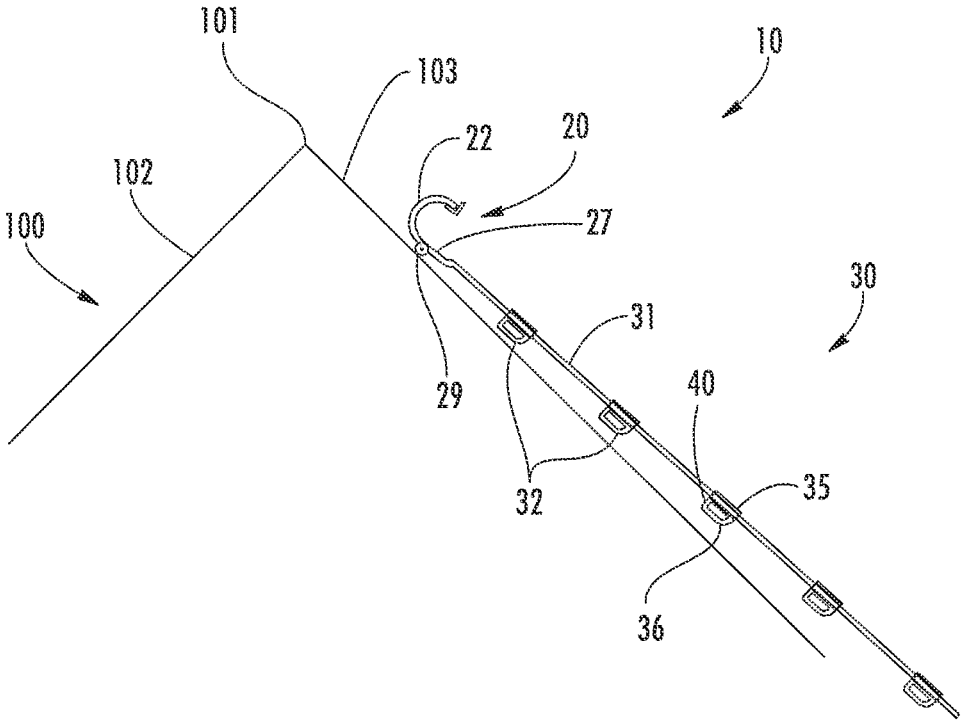
FIG. 4 depicts a side view similar to that of FIG. 1 but with the roof climbing tool inverted for sliding along a roof surface.

If desired, peak engagement section 20 may include a tool sliding member or section to facilitate sliding of the roof climbing tool 10 along the roof 100. More specifically, the straight section 27 of body 21 may have a wheel or roller 29 (FIG. 3) rotatably mounted thereon. The roller 29 may be mounted on body 21 with bolts or other types of fasteners. The roller 29 assists an operator to slide the roof climbing tool 10 along the second roof surface 103 of the roof 100 and minimizes any damage to the roof and also increases the control that the operator has over the tool while moving it along the roof. In operation, the operator may invert or turn the roof climbing tool 10 over so that the roller 29 engages the roof 100 (FIG. 4). The operator may then slide the roof climbing tool 10 upward towards the peak 101 of the roof 100. Once the peak engagement section 20 extends over the peak 101 of the roof 100, the tool 10 may be turned over and so that the peak is positioned within the open area 23 defined by the arcuate member 22 and the roof engaging member 24 engages the first roof surface 102 and the operator engagement section 30 engages the second roof surface 103 (FIG. 2).

Peak engagement section 20 may be formed of a lightweight, strong material such as aluminum or any other suitable material. If desired, the peak engaging member 20 may be formed as a one-piece, integrally formed member. The roller 29 may be formed of any material that is unlikely to damage the roof 100. In one example, the roller 29 may be formed of aluminum. In another example, the roller 29 may be formed of a resilient material such as rubber.

Figure 5:
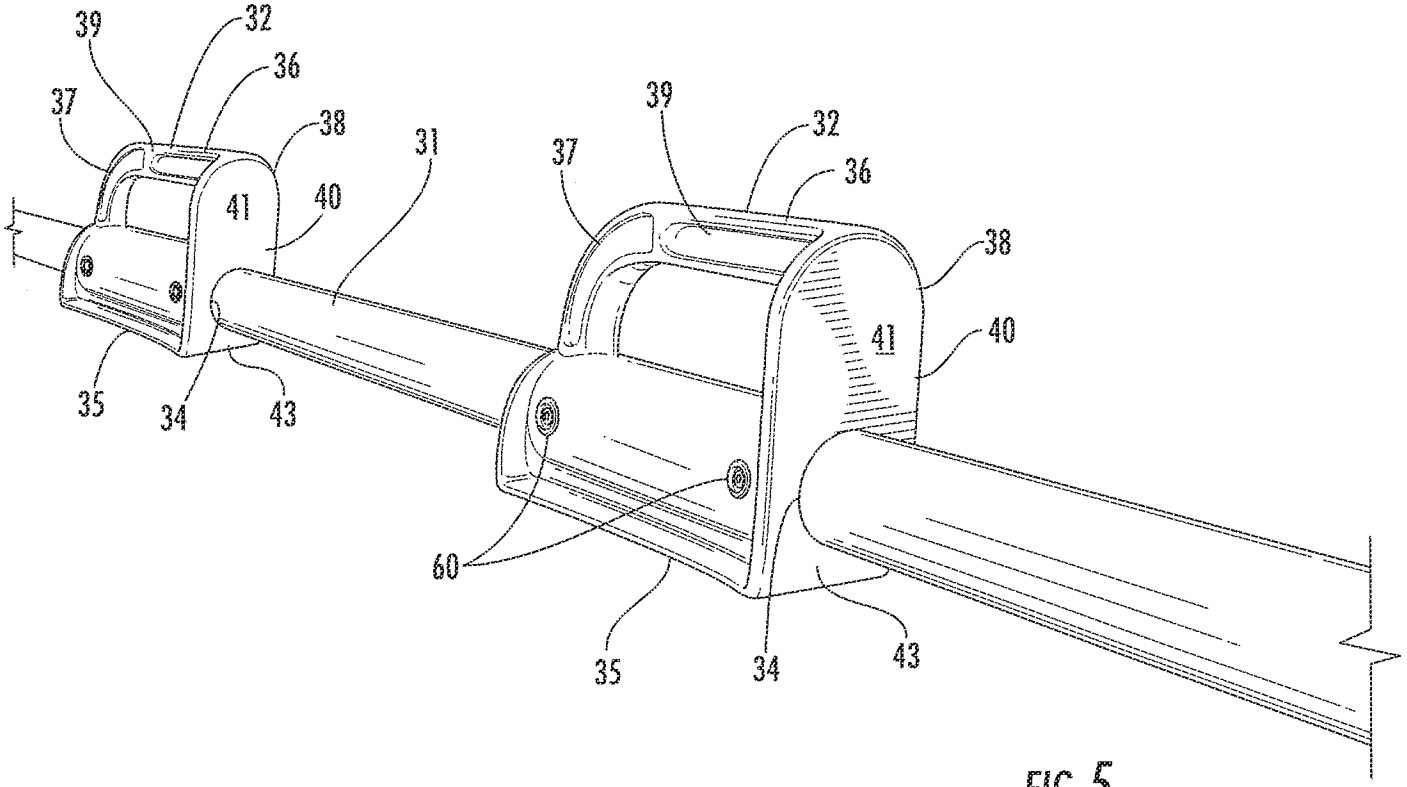
FIG. 5 depicts a fragmented perspective view of a portion of an operator engagement section of the roof climbing tool of FIG. 1.
Figure 6:
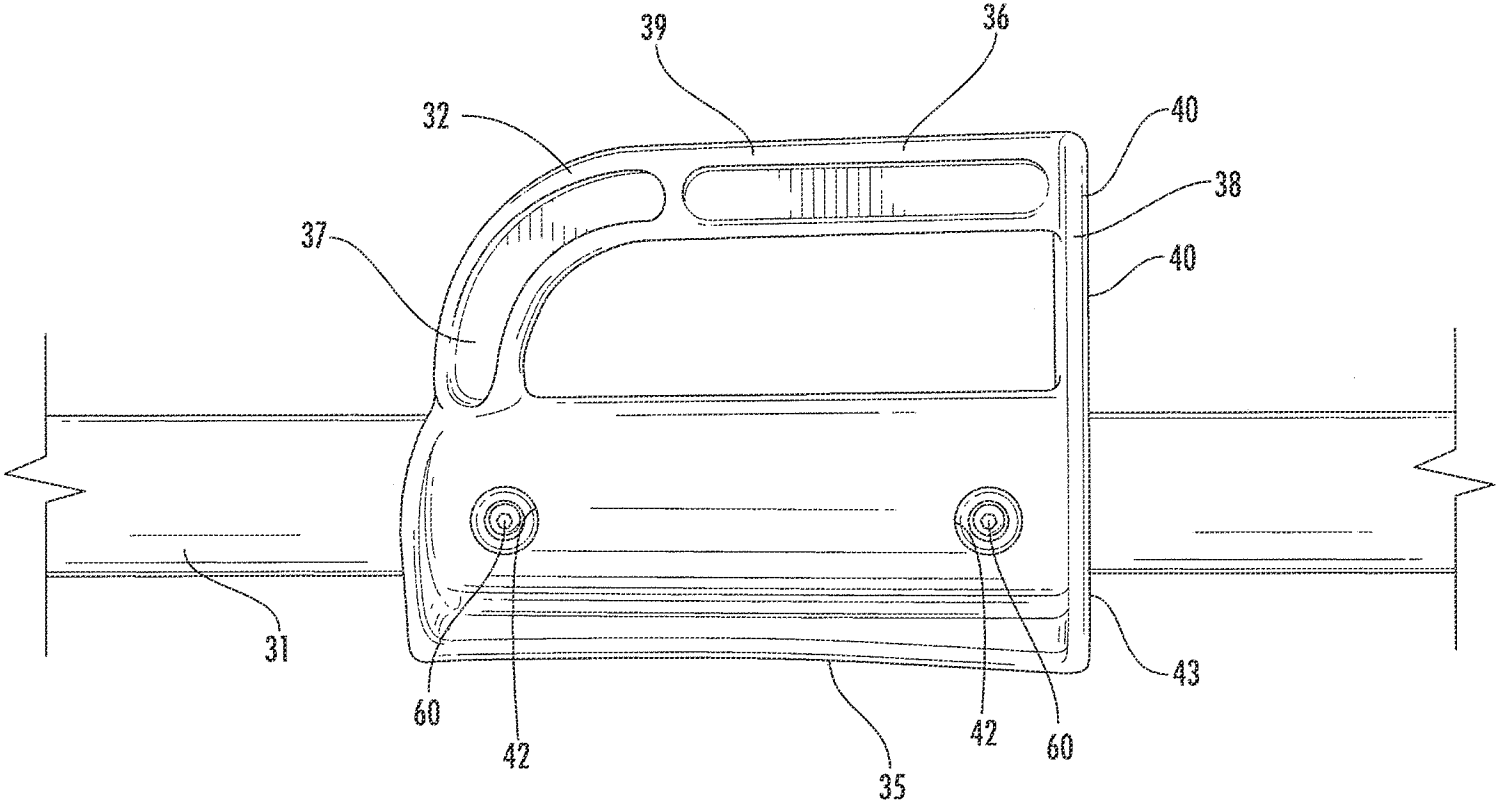
FIG. 6 depicts a side view of a portion of FIG. 5 depicting a portion of a shaft and a step handle.

Referring to FIGS. 1 and 5-6, the operator climbing or engagement section 30 includes an elongated central body configured as a rod or shaft 31 with a plurality of step handles 32 positioned along the shaft. As depicted, shaft 31 is an elongated tubular, rigid member formed of a plurality of interlocking sections but may be formed in other configurations such as from a one-piece member or from a pair of parallel shafts. Shaft 31 may be formed of a lightweight, strong material such as steel or any other suitable material.

Step handle 32 has a body 33 with a cylindrical main bore 34 dimensioned to receive shaft 31 therethrough. The body 33 includes a first or roof engaging surface 35, a graspable member or handle 36, and a step or foot engaging surface 40. The roof engaging surface 35 may be generally planar or flat so as to engage the second roof surface 103 of the roof 100 when the roof climbing tool 10 is operatively positioned against the second roof surface. The flat surface of the roof engaging surface 35 permits the even distribution of forces on the second roof surface 103 which reduces wear on the roof 100 and increase the stability of the roof climbing tool 10. In addition, the body 33 spaces the handle 36 from the second roof surface 103 to improve an operator's ability to grasp the handles.

The handle 36 is generally U-shaped and extends away or in a direction opposite from the roof engaging surface 35. Handle 36 includes a first leg 37, a second leg 38, and a connecting member 39 extending between the first and second legs. The first leg 37 may be curved or arcuate if desired to facilitate manual engagement by the hand of an operator. The second leg 38 may be straight or include a straight section if desired to facilitate engagement by the foot of an operator as described in further detail below. Connecting member 39 connects the first leg 37 to the second leg 38 and may be generally straight or have another configuration that permits manual engagement by the hand of an operator. As depicted in the drawings, the connecting member 39 may be generally parallel to shaft 31.

The foot engaging surface 40 may be formed as part of the handle 36 and may include a generally flat surface 41. Each step handle 32 is positioned on shaft 31 so that the foot engaging surface 40 of each step handle faces upward or towards the peak engagement section 20. As may be understood from the foregoing, while scaling a roof 100, an operator's hands may grip any of the handles 36 while the operator's feet engage any of the foot engaging surfaces 40.

Step handle 32 may be mounted on shaft 31 in any desired, secure manner. In one example, body 33 may have a plurality of fastening bores 42 extending therethrough generally perpendicular to the main bore 34. Shaft 31 may have a similar plurality of fastening bores (not shown) aligned with the fastening bores 42 of the step handles 32. Fasteners such as rivets 60 or bolts may extend through the fastening bores 42 in the step handles 32 and the fastening bores in the shaft 31 to secure the step handles in place on the shaft 31.

In one embodiment, the step handles 32 may be a one-piece, integrally formed, injection molded component formed of resin or plastic. During warmer months, the surface of a roof 100 may reach relatively high temperatures. The use of step handles 32 formed of an insulative material such as resin may be advantageous as they may not reach as high a temperature as metal components. In addition, each step handle has a spacing section or offset 43 that spaces the main bore 34 from the roof engaging surface 35 and thus spaces the shaft 31 from the second roof surface 103 to reduce the amount of heat exchanged between the second roof surface 103 and the shaft 31. Further, since the handle 36 of step handle 32 extends away from roof engaging surface 35, the handle is spaced from a potentially hot roof surface by a distance equal to the diameter of the main bore 34 plus the height of the offset 43.

The peak engagement section 20 may be connected to the operator engagement section 30 in any desired manner. In one embodiment, a connector 17 is mounted inside shaft 31 of the operator engagement section 30. The body 21 of the peak engagement section 20 may fit inside the connector 17. The connector 17 and body 21 have a plurality of bores (not shown) extending therethrough generally perpendicular to the shaft 31. Shaft 31 may have a similar number of bores 19 aligned with the bores of the connector 17 and body 21. Fasteners such as locking pins 61 may extend through the bores 19 in the shaft 31 and the bores in the connector 17 and body 21 to secure the peak engagement member 20 to the operator engagement member 30.

The operator engagement section 30 may be configured to have any desired length and any number of step handles 32 affixed thereto. For convenience during transportation, peak engagement section 20 and the operator engagement section 30 may be separable. Still further, while the operator engagement section 30 may be a one-piece member, it may also be formed of a plurality of sections that may be locked or secured together at a work site.

Figure 7:
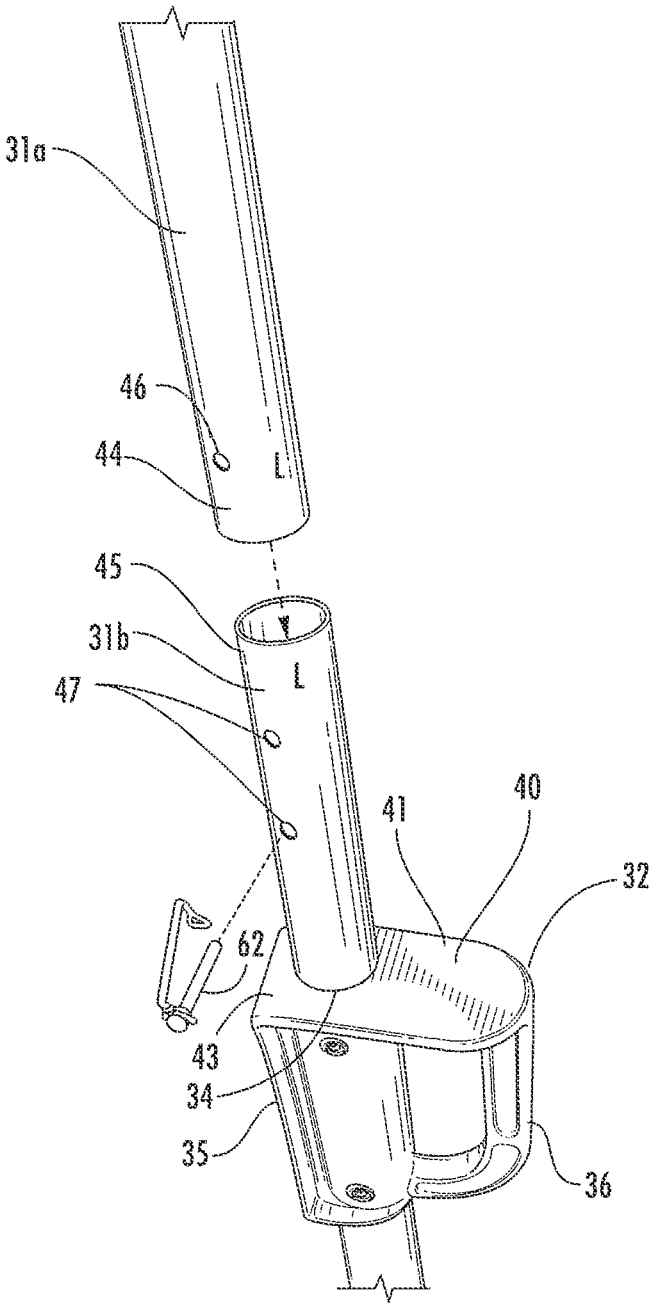
FIG. 7 depicts a perspective view of the assembly of a pair of shaft sections of the roof climbing tool of FIG. 1.

Any number of shaft sections 31*a*, 31*b* (FIG. 7) of the shaft 31 may be secured together to extend the length of the roof climbing tool 10 to facilitate its use with roofs 100 of different heights. FIG. 7 depicts a manner in which a first shaft section 31*a* may be interconnected to a second shaft section 31*b*. More specifically, each of the shaft sections includes a first or male end 44 that may be inserted or telescopes into a second or female end 45 of an adjacent shaft section. More specifically, the first end 44 is slightly smaller in diameter than the second end 45 to facilitate the insertion process. The first end 44 includes one or more first fastening bores 46 and the second end 45 includes one or more second fastening bores 47. During assembly, a first end 44 of one shaft section, such as first shaft section 31*a*, is aligned with and inserted into a second end 45 of another shaft section, such as second shaft section 31*b*. The first fastening bore 46 is aligned with one of the second fastening bores 47 and a locking pin 62 is inserted through both bores to secure the shaft sections 31*a*, 31*b* together. The process may be repeated with as many shaft sections as desired. Accordingly, each shaft section may include both the first and second ends. Other manners of assembling shaft sections together to form shaft 31 are contemplated.

Figure 9:
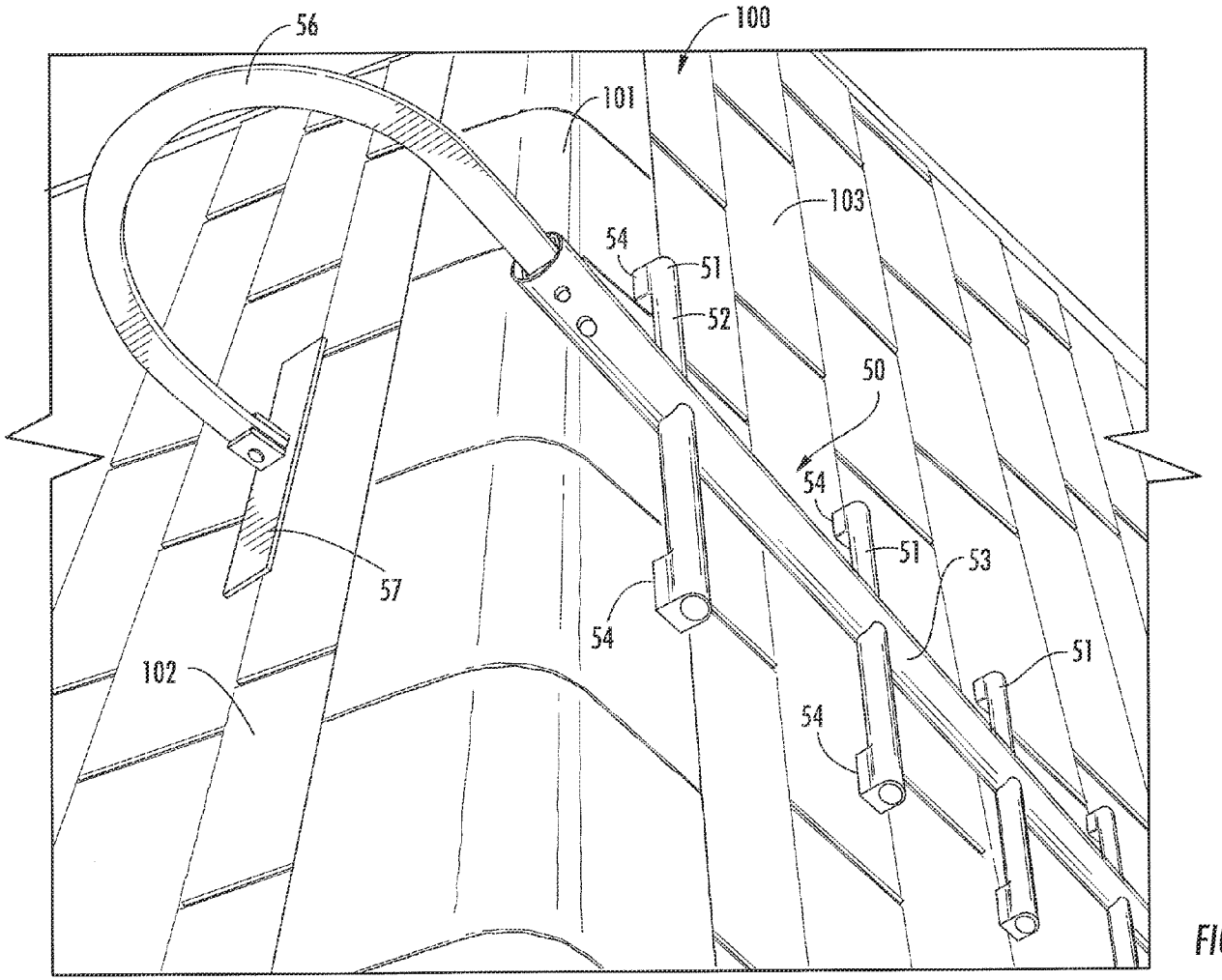
FIG. 9 depicts a perspective view of a portion of an alternate embodiment of a roof climbing tool in use in accordance with the disclosure.

FIG. 9 depicts an alternate embodiment of a roof climbing tool 50 with an alternate embodiment of step handle 51. Each step handle 51 is formed of a cylindrical member 52 that extends perpendicularly to shaft 53. Step handles 51 may include roof engaging flat surfaces 54 at each end 55 thereof to increase the stability of the roof climbing tool 50 on the roof 100 and to raise the step handles off of the second roof surface 103. Roof climbing tool 50 further includes an alternate embodiment of roof engagement section 56 that does not include an offset adjacent the intersection of the shaft 53 and the roof engagement section 56. Still further, roof climbing tool 50 does not include a sliding member and the roof engaging member 57 is generally rectangular.

In use, as an operator accesses the roof 100, the roof climbing tool 10 may be inverted and positioned so that the roller 29 faces and engages the roof 100 as depicted in FIG. 4. The operator may then slide the roof climbing tool 10 up the roof 100 towards the peak 101 while roller 29 rotates. The engagement of the roller 29 with the roof 100 and the rotation of the roller minimizes wear on the roof surface. Once the operator has positioned the roof climbing tool 10 so that the peak engagement section 20 is sufficiently close to the peak 101, the operator may rotate and lower or otherwise change the position of the roof climbing tool to place the roof climbing tool in the operative position depicted in FIG. 2. At such position, the roof engaging member 24 engages the first roof surface 102 and the roof engaging surface 35 of each step handle 32 engages the second roof engaging surface 103 while the peak 101 is positioned within open area 23 of arcuate member 22.

The invention claimed is:

1. A tool for engaging a roof, the roof including a first surface and a second surface intersecting at a peak, the tool comprising:

a peak engagement member for engaging the first surface of the roof; and an operator climbing member including an elongated central shaft, and a plurality of spaced apart step handles mounted on the central shaft, each step handle having an elongated body with a bore extending therethrough, a generally flat roof engaging surface spaced away from the shaft and a generally U-shaped handle extending opposite the roof engaging surface, the U-shaped handle having an elongated bight that is generally parallel to the central shaft, the bore of each step handle is disposed between the U-shaped handle and the roof engaging surface of each the step handle, the shaft extending through the bore of each step handle, the operator climbing member being configured for engaging the second surface of the roof and being operatively connected to the peak engagement member.

2. The tool of claim 1, wherein each U-shaped handle has first and second legs the bight connecting the first and second legs, one end of each of the first and second legs extending from the body, and one of the first and second legs having a foot engaging surface to be engaged by an operator's foot.

3. The tool of claim 2, wherein the foot engaging surface is generally flat.

4. The tool of claim 1, wherein the peak engagement member includes tool sliding member to facilitate sliding of the tool along the first surface of the roof.

5. The tool of claim 4, wherein the tool sliding member includes a rotatable wheel.

6. The tool of claim 5, where the tool sliding member is rotatably mounted on a straight section of the peak engagement member.

7. The tool of claim 1, wherein the elongated central shaft comprises a plurality of shaft sections and the plurality of shaft sections are dimensioned to permit at least one shaft section to fit into an adjacent shaft section.

8. The tool of claim 1, wherein each step handle is made of plastic material.

9. The tool of claim 1, wherein the peak engagement member includes a roof engagement member configured to engage the first surface of the roof and an arcuate section operatively connected to the roof engagement member, the arcuate section having an open area configured to receive a portion of the peak therein.

10. The tool of claim 3, wherein the foot engaging surface is generally perpendicular to the shaft.

11. A tool for engaging a roof, the roof including a first surface and a second surface intersecting at a peak, the tool comprising:

a peak engagement member for engaging the first surface of the roof; and an operator climbing member including an elongated central shaft, and a plurality of spaced apart step handles mounted on the central shaft, each step handle having an elongated body with bore extending therethrough, a generally flat roof engaging surface spaced away from the shaft and a generally U-shaped handle extending opposite the roof engaging surface, the U-shaped handle having an elongated bight that is generally parallel to the central shaft, the bore of each step handle is disposed between the U-shaped handle and the roof engaging surface of each the step handle, the shaft extending through the bore of each step handle, the operator climbing member being configured for engaging the second surface of the roof and being operatively connected to the peak engagement member, wherein each U-shaped handle has first and second legs and the bight connecting the first and second legs, one end of each of the first and second legs extending from the body, and one of the first and second legs having a foot engaging surface to be engaged by an operator's foot, wherein the foot engaging surface is generally perpendicular to the shaft.

12. A tool for engaging a roof, the roof including a first surface and a second surface intersecting at a peak, the tool comprising:

a peak engagement member for engaging the first surface of the roof; and an operator climbing member including an elongated central shaft, and a plurality of spaced apart step handles mounted on the central shaft, each step handle having an elongated body with bore extending therethrough, a generally flat roof engaging surface spaced away from the shaft and a generally U-shaped handle extending opposite the roof engaging surface, the U-shaped handle having an elongated bight that is generally parallel to the central shaft, the bore of each step handle is disposed between the U-shaped handle and the roof engaging surface of each the step handle, the shaft extending through the bore of each step handle, the operator climbing member being configured for engaging the second surface of the roof and being operatively connected to the peak engagement member, wherein each step handle is made of plastic material and the shaft is made from steel.

* * * * *